US008267259B2

(12) United States Patent
Fisher et al.

(10) Patent No.: US 8,267,259 B2
(45) Date of Patent: Sep. 18, 2012

(54) CUP FOR HOLDING BOTTLES IN A BOTTLE RACK

(75) Inventors: Robert E. Fisher, Santa Rosa, CA (US); Robert W. Thompson, Santa Rosa, CA (US)

(73) Assignee: Wunderwall, LLC, Santa Rosa, CA (US)

( * ) Notice: Subject to any disclaimer, the term of this patent is extended or adjusted under 35 U.S.C. 154(b) by 158 days.

(21) Appl. No.: 12/760,373

(22) Filed: Apr. 14, 2010

(65) Prior Publication Data

US 2010/0258698 A1 Oct. 14, 2010

Related U.S. Application Data

(60) Provisional application No. 61/169,043, filed on Apr. 14, 2009.

(51) Int. Cl.
*A47B 73/00* (2006.01)
*A47F 5/08* (2006.01)

(52) U.S. Cl. ..... 211/75; 211/89.01; 248/220.31

(58) Field of Classification Search ..... 211/74, 211/75, 60.1, 63, 86.01, 89.01, 105.4; 248/103, 248/105, 106, 220.31–220.43; 269/47, 289 R, 269/95; 215/277, 278, 218, 276, 283, 334, 215/219–221; 70/370–371; 16/2.1, 2.4; 138/96 T, 96 R
See application file for complete search history.

(56) References Cited

U.S. PATENT DOCUMENTS 228,171 A * 6/1880 Boyd ..... 138/96 T
1,874,514 A * 8/1932 Hansen ..... 248/106
2,338,310 A * 1/1944 Barnes ..... 211/74
2,744,405 A * 5/1956 McClelland ..... 70/81
2,974,806 A * 3/1961 Seewack ..... 211/123
2,992,685 A * 7/1961 Madsen ..... 416/245 R
3,074,579 A * 1/1963 Miller ..... 215/344
3,434,615 A * 3/1969 Barletta ..... 215/276
3,637,180 A * 1/1972 Parry ..... 248/553
3,814,293 A * 6/1974 Daves ..... 222/173
3,901,389 A * 8/1975 Belokin, Jr. ..... 211/74
3,958,710 A * 5/1976 Harding et al. ..... 215/254
4,069,935 A * 1/1978 Hampel ..... 215/203
D250,625 S 12/1978 Leventhal
D253,802 S 1/1980 Loud et al.
4,496,124 A * 1/1985 Cole ..... 248/146
4,795,038 A 1/1989 Johnson
4,819,815 A * 4/1989 Tarlow et al. ..... 211/74
5,180,066 A * 1/1993 McArdle ..... 211/74
5,183,171 A * 2/1993 Pherigo ..... 220/258.3
5,186,341 A * 2/1993 Zeid ..... 211/204
5,197,612 A * 3/1993 Thomson ..... 211/74
5,295,377 A * 3/1994 Moricz et al. ..... 70/379 R
5,478,325 A * 12/1995 Fu-Hsiang ..... 604/212
5,533,794 A * 7/1996 Faison ..... 301/105.1
6,105,405 A * 8/2000 Westwinkel ..... 70/371
6,299,006 B1 * 10/2001 Samonek ..... 215/307

(Continued)

*Primary Examiner* — Teri P. Luu
*Assistant Examiner* — Devin Barnett
(74) *Attorney, Agent, or Firm* — Craig M. Stainbrook; Stainbrook & Stainbrook, LLP

(57) ABSTRACT

A cup-shaped receptacle designed to engage the neck of a bottle and rigidly support it in a near horizontal position. The receptacle can be incorporated into many common building materials, so an array of the receptacles permits an attractive display of bottles. Bottles are held in place through the force of gravity and by resilient rings or gaskets disposed in the interior of the receptacle that limit vertical and horizontal migration of bottles. The rings also protect foil caps from damage.

5 Claims, 6 Drawing Sheets

U.S. PATENT DOCUMENTS 6,371,313 B1 * 4/2002 Walter et al. ..... 211/123
6,527,301 B1 * 3/2003 Bathey ..... 285/45
7,080,743 B1 * 7/2006 Wolseth ..... 211/74
2001/0035223 A1 * 11/2001 Rahimzadeh et al. ..... 138/96 R
2004/0108294 A1 * 6/2004 Bloom et al. ..... 215/276
2005/0211657 A1 * 9/2005 Mallet et al. ..... 215/252
2006/0065612 A1 * 3/2006 Gonneville ..... 211/75
2009/0321378 A1 * 12/2009 Battegazzore ..... 215/219
2010/0089484 A1 * 4/2010 Courtois et al. ..... 138/96 T

* cited by examiner

CUP FOR HOLDING BOTTLES IN A BOTTLE RACK

CROSS REFERENCES TO RELATED APPLICATIONS

The present application claims the benefit of U.S. Provisional Patent Application Ser. No. 61/169,043, filed Apr. 14, 2009 (Apr. 14, 2009).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

SEQUENCE LISTING

Not applicable.

BACKGROUND OF THE INVENTION

1. Field of the Invention

The present invention relates generally to bottle supports, and more particularly to a bottle holding apparatus for holding a bottle exclusively by its neck, thereby displaying the bottle front below the shoulder. Still more particularly, the present invention relates to a rigid removable cup for installation in a wall or other structural substrate that includes resilient internal rings for cushioning and protecting the bottle during storage. The invention can be used with any product packaged in a bottle with a suitably sized neck. This application emphasizes and highlights the advantageous features of the invention in the context of wine bottle storage and presentation.

2. Discussion of Related Art Including Information Disclosed Under 37 CFR §§1.97, 1.98

Wine bottles storage techniques frequently strike a balance between two objectives: (1) a proper positioning of the bottle to ensure minimal exposure to oxygen, minimal ullage, and minimal agitation; and (2) an open presentation of the wine label for easy and rapid identification, selection, and obtention of the particular bottle sought. To that end countless wine bottle racks and bottle holding apparatus have been devised. Such bottle holding apparatus often utilize some kind of upright planar member with one or more circular openings that engage the bottle neck and thereby support the bottle. Such apparatus can be seen, for example, in U.S. Des. Pat. No. Des. 250,625, to Leventhal, U.S. Design Pat. No. Des. 253, 802 to Loud, et al; U.S. Des. Pat. No. Des. 2,338,310 to Barnes, and U.S. Design Pat. No. 4,496,124, to Cole.

Other pertinent prior art publications notably include U.S. Pat. No. 4,795,028 to Johnson, which teaches a bottle rack that engages the necks of bottles through a plurality of spaced-apart, stalk mounted, bilaterally symmetrical, paired, tapered ring members and rigidly supports bottles in a near horizontal position. The ring members are arranged in front-rear pairs such that the neck of a supported bottle may be inserted through the ring members and engage the tapered end of the front ring member along the lower portion of the bottle neck and the tapered end of the rear ring member along the upper portion of the bottle neck while the bottle is in the near horizontal position. The supported bottle is held rigidly by gravity acting on the bottle and against the four points of contact with the ring members. A support structure provides means for rigidly supporting the rack on a surface or attachment to a wall, or the like.

U.S. Pat. No. 7,080,743 to Wolseth, discloses a wine bottle rack that includes a base platform and a second substantially rigid wall connected to the base at an obtuse angle and having a plurality of apertures. The apertures are adapted for supporting wine bottles in a cantilevered manner from the rack.

U.S. Pat. No. 5,197,612 to Thomson shows an X-shaped bipod bottle stand having legs with apertures for receiving the necks of bottles to support the bottles in cantilever fashion.

U.S. Pat. No. 4,496,124 to Cole teaches a bottle support including an oblique prism with a rectangular base and two sets of parallel sides. A hole penetrates the prism through the sides, generally parallel to two of the sides. The center of gravity of the body lies outside the base and the combined center of gravity of the body and bottle lies above the base.

What may not be readily appreciated from a cursory review of the above-identified patents is that prior art bottle supports utilizing non-engineered, circular apertures allow a considerable amount of undesirable lateral movement of bottles. Attempts at reducing that lateral movement typically require the addition of a third point of contact someplace along the neck of the bottle, accomplished either through the use of steep aperture angles or planar member inclination angles. Most such attempts, however, have been largely unsuccessful owing to the fact that the third point is positioned in the same vertical plane as the original two points with respect to the longitudinal axis of the bottle. In addition, the steep angles required cause any sediment in wine bottles to settle in the neck and against the cork and present wine labels in an upside down orientation, which causes some difficulty in reading the labels.

An alternative approach to reducing lateral movement has been directed to using semi-resilient materials such as pressed paper or cardboard for the upright support members, in which event the edges of the supporting opening crush slightly under the load of the supported bottle such that the opening conforms to the shape of said bottle. But it will be appreciated that repeated insertion and removal of bottles causes a deterioration in the integrity of the structure. [See, for instance, Belokin, Jr. U.S. Pat. No. 3,901,389.]

Yet another approach to solving the problem of lateral movement is to use projecting support pegs. But this adds considerable mass to the support structure.

What is needed is a bottle holding apparatus that can be easily incorporated into building materials, so that a bottle display can be made part of a wall or other decorative surface. Such a device should eliminate horizontal and lateral movement in the supported bottles by carefully engineering interior dimensions of the holding apparatus and employing resilient inserts to capture and cushion the bottle neck.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The present invention is an improved bottle storage and display device. It is especially well-suited to the storage and display of long-necked bottles, such as wine bottles.

The inventive apparatus in its most essential aspect is a modular receptacle formed from a rigid cylindrical piece that may be easily incorporated into common building materials. It can be disposed in an array comprising a plurality of receptacles so as to permit easy access to a number of bottles and easy viewing of a number of bottle labels. The receptacle includes resilient insert rings or gaskets disposed on the interior side of the receptacle to protect foil caps from damage and to prevent bottle movement both vertically and horizontally. Carefully engineered inner dimensions ensure that bottles are held rigidly in position by the force of gravity. However, a bottle may be removed from the rack simply by lifting the exposed end of the bottle and withdrawing the bottle from the receptacle.

The receptacles may be affixed to virtually any material suitable for a free-standing display because of an annular threaded nut is secured to the threaded receptacle neck to capture the material between the nut and the receptacle flange. This ability to incorporate the receptacle into many materials is a significant advancement over earlier rack inventions.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
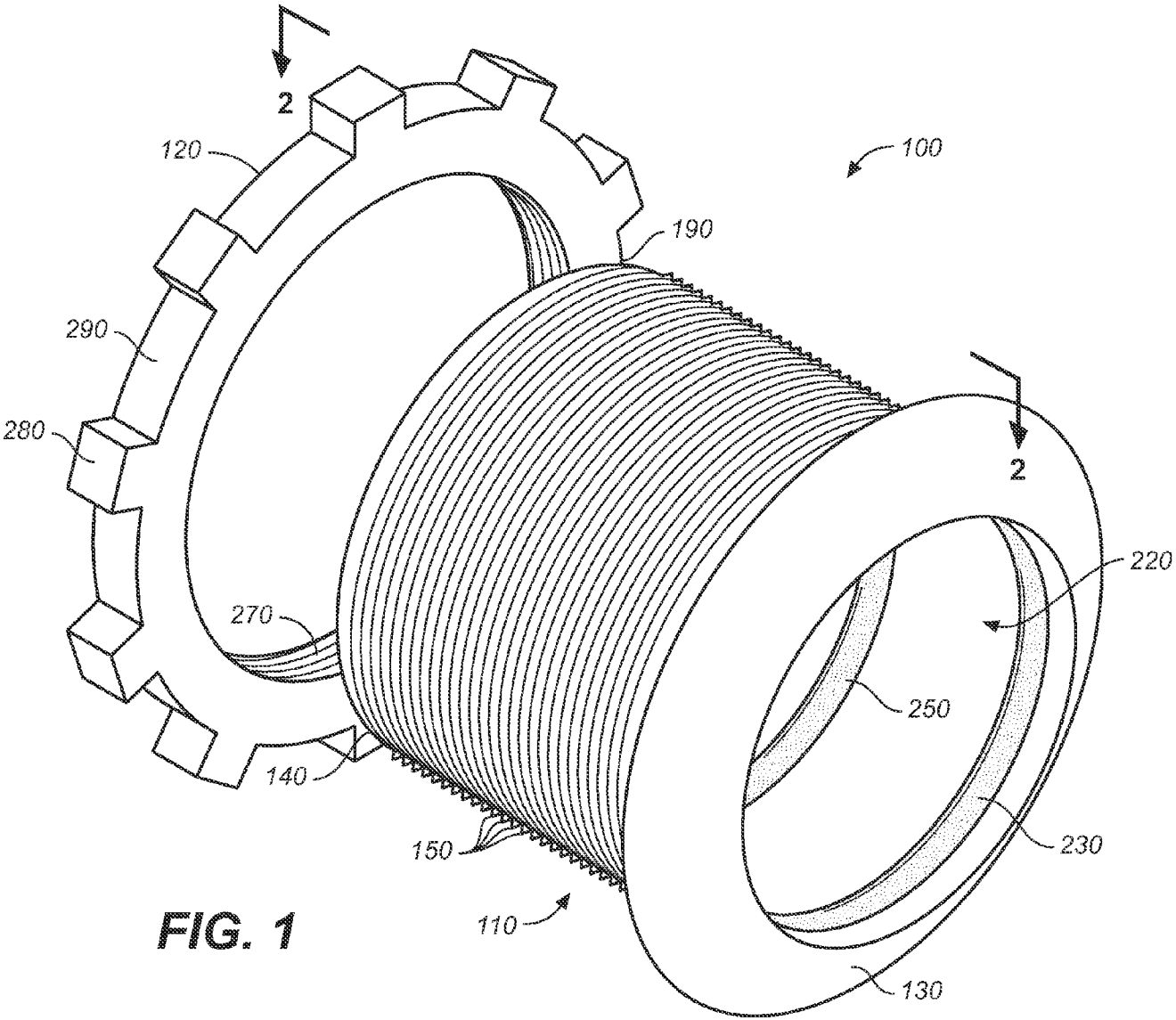
FIG. 1 is a perspective view the inventive bottle holding cup of the present invention.

Referring first to FIGS. 1 through 4, wherein like reference numerals refer to like components in the various views, there is illustrated therein a new and improved cup for holding bottles in a bottle rack, generally denominated 100 herein.

Figure 2:
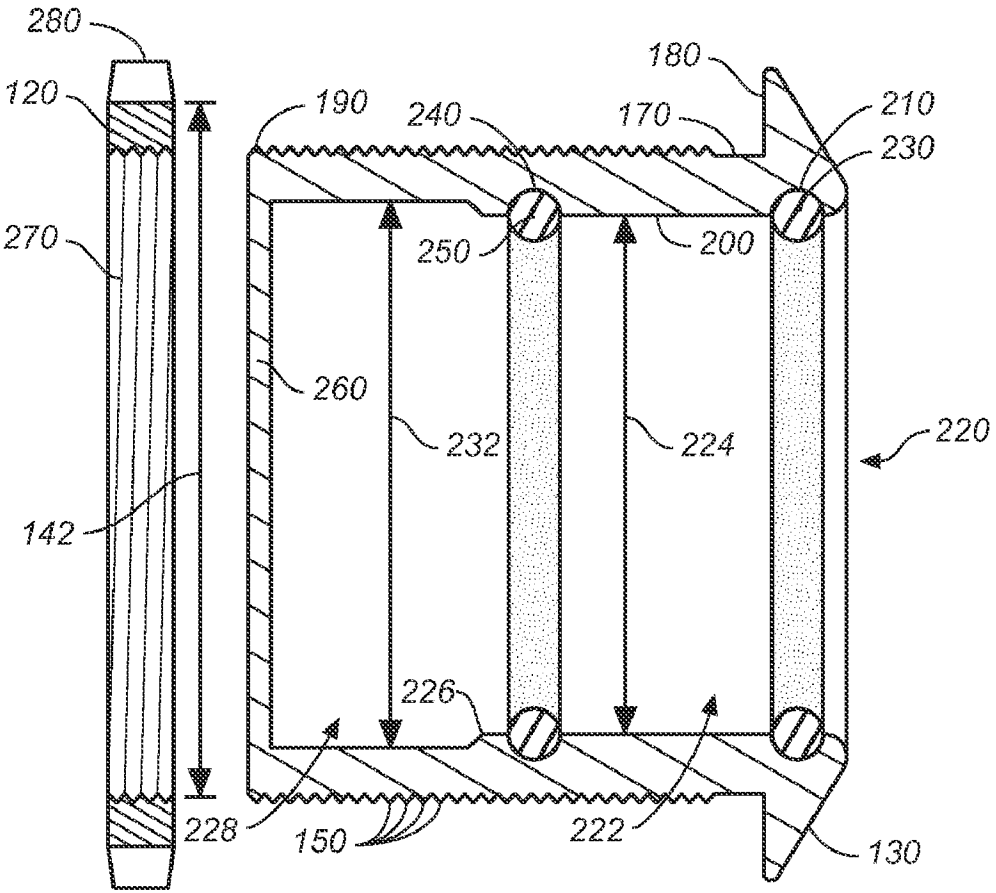
FIG. 2 is a cross-sectional side view in elevation thereof.

Referring first to FIGS. 1-2, the inventive cup of the present invention most essentially includes a receptacle portion 110 and a locking nut 120. The receptacle portion includes a beveled outer flange 130 and a cylindrical body 140 having male threads 150 disposed on its exterior side 160 and extending from a point 170 proximate the outer flange underside 180 to the inner end 190 of the cylindrical body. In a preferred embodiment, the outer diameter 142 of the cylindrical body may taper slightly from the outer flange underside to the inner end, such that the outer diameter of the cylindrical body at the inner end is slightly smaller than the outer diameter near or at the underside of the outer flange. This facilitates placement of the cup into holes cut into a substrate.

The interior side 200 of the receptacle portion includes a first annular channel 210 proximate the mouth or opening 220 of the receptacle portion and in which a first annular resilient gasket 230 is disposed. It next includes a second annular channel 240, spaced apart from the first annular channel, and in which a second annular resilient gasket 250 is disposed. The inner end 190 is closed or sealed with an integrally formed cap 260. The receptacle portion is roughly divided into two cylindrical chambers. The first cylindrical chamber 222 is proximate the opening 220 and has a first diameter 224 that continues interiorly a small distance past, and the second resilient annular gasket 250, where a ridge 226 angles outwardly to define the edge of a second cylindrical chamber 228 having a second diameter 232 slightly greater than the first diameter.

The nut 120 is a generally annular ring having female threads 270 complementary to the male threads of the receptacle body. Knobs, nubs, or other protrusions 280 can be provided on the outer side 290 of the nut to facilitate easy handling when installing or removing the unit.

Figure 3:
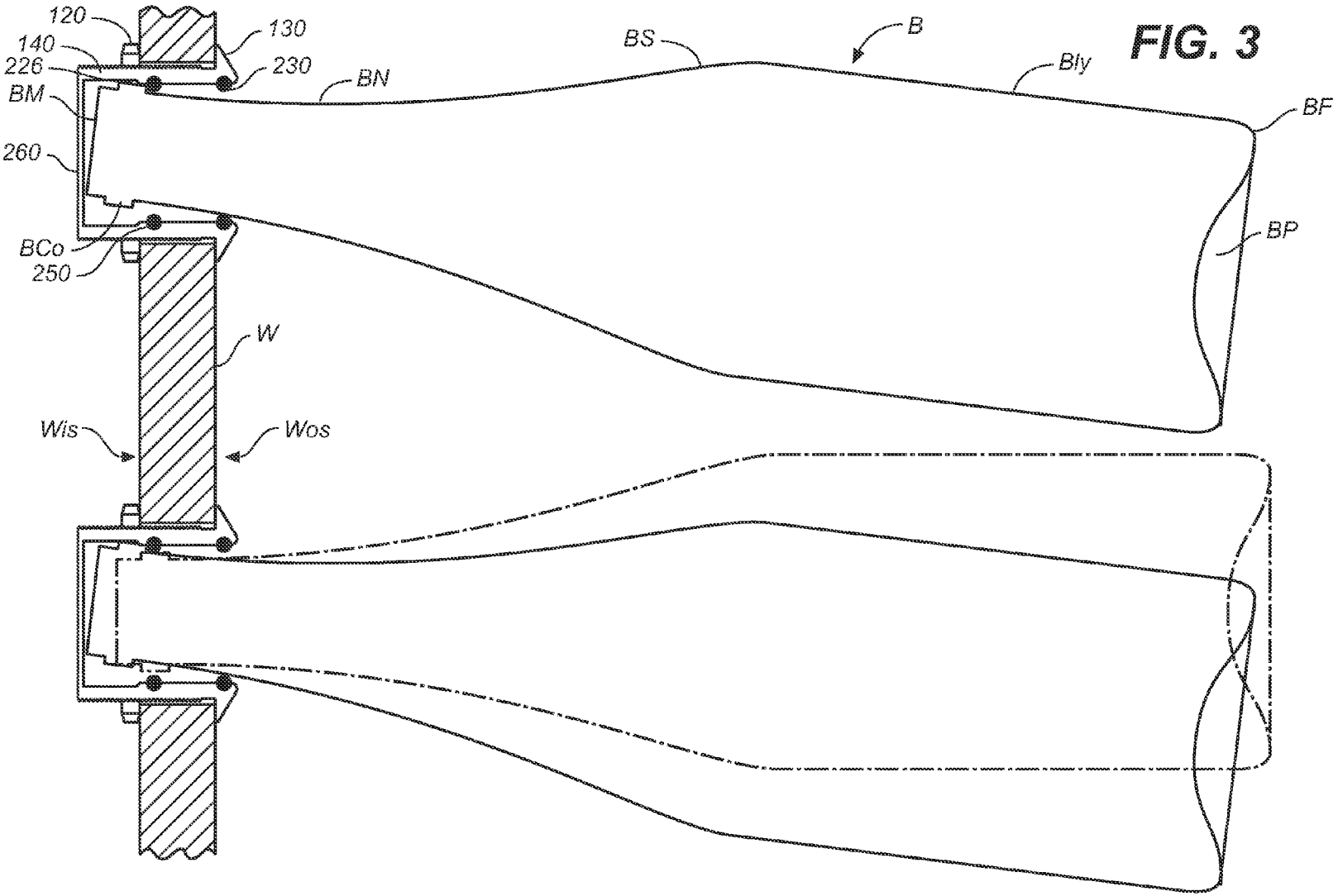
FIG. 3 is a cross-sectional side view in elevation showing two of the inventive apparatus installed on a building wall and each holding a bottle in a cantilevered manner.

FIG. 3 shows two of the inventive bottle holding cups installed in a wall W. Here it is seen that the cylindrical body 140 of the inventive cup is inserted through the wall so as to bring the underside 180 of the outer flange 130 into engagement with the outer surface Wos of the wall in such a manner that its threads are exposed on the opposite (inner) side Wis of the wall. The nut is threadably installed on the cylindrical body such that the outer flange and nut capture the wall to securely retain the receptacle portion in the wall. A typical wine bottle B is shown inserted into each of the installed cups. Such a bottle includes a bottle cylinder Bcy, a shoulder BS, a neck BN, a collar Bco, a mouth BM, a punt BP, and an annular foot BF.

Looking at the upper bottle in FIG. 3, it will be appreciated that when fully inserted into the receptacle, the mouth BM of bottle B is generally brought into contact with end cap 260, while the bottle collar Bco or the neck BN proximate the collar is brought into engagement with the ridge 226 and the second annular gasket 250 in the superior portion of the receptacle body. At the same time the bottle neck BN more proximate the bottle shoulder BS engages the first annular gasket in the inferior portion of the receptacle body and the BN proximate the collar engages the second annular gasket at the superior portion of the receptacle body, further securing the bottle. The bottle is thus retained and protected from damage. Moreover, the bottle is held at an approximate 6% angle in relation to ground, thereby keeping wine in contact with the cork, a feature that is critical to proper wine storage.

Looking next at the lower bottle in FIG. 3, it will be appreciated that the bottle is removed simply by gently lifting it out of engagement with the first and second annular gaskets and pulling it out from the receptacle body.

Figure 4:
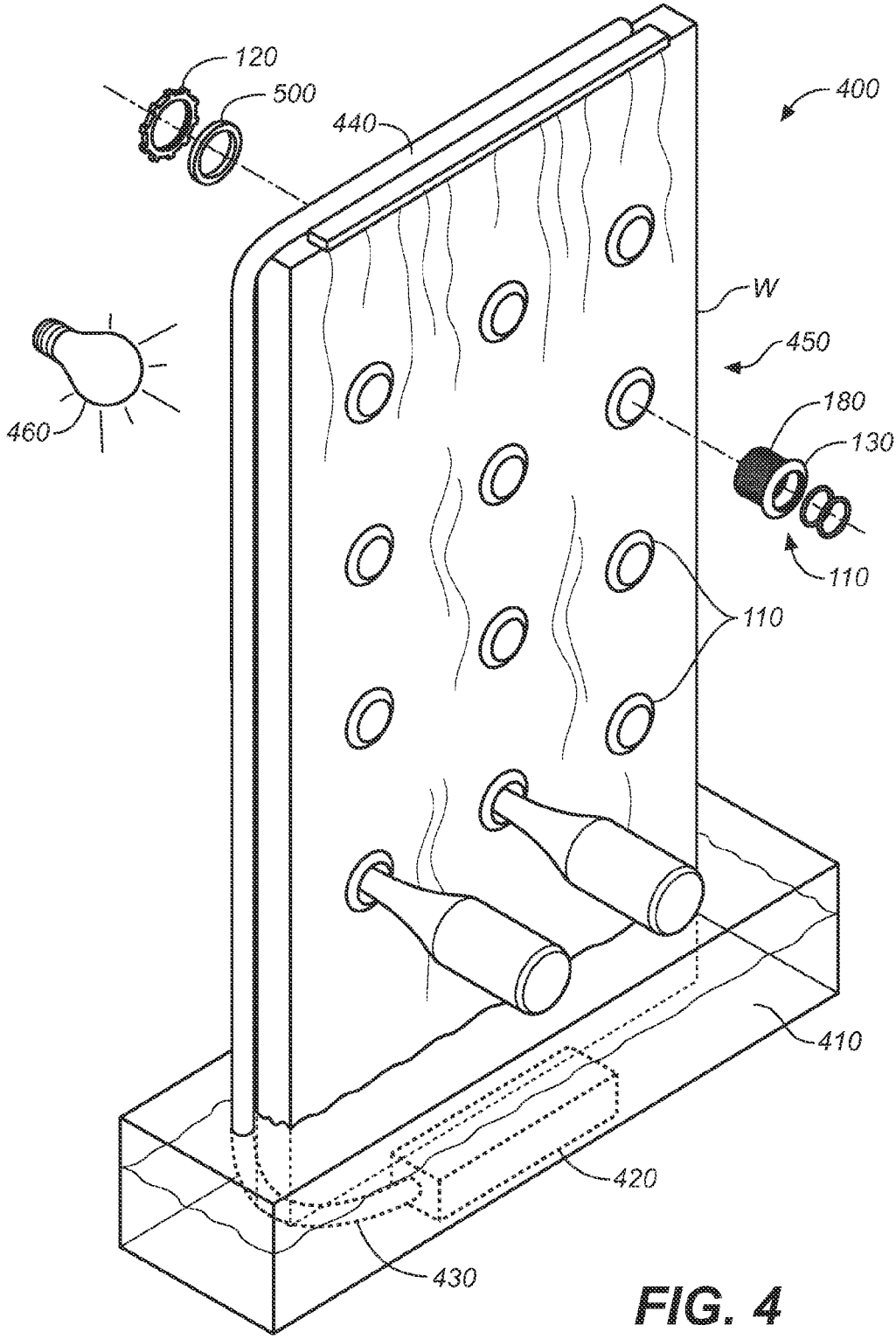
FIG. 4 is a perspective view showing how the inventive bottle holding cup can be installed on a decorative display and used in connection with a fountain and light source to produce an exotic lighted water feature.

The inventive apparatus can be fabricated from a number of suitably rigid and durable materials. However, 6061-T6 aluminum is a preferred material, as is a clear transparent, or colored semi-transparent, plastic acrylic or polycarbonate. Referring now to FIG. 4, when a plastic acrylic or polycarbonate material is employed, the inventive bottle holding cup can be incorporated into an exotic bottle display 400 comprising a plurality of receptacles installed in a wall or free standing planar module W. Such a display might include a water reservoir 410 having a pump 420 and a fluid conduit 430 for conveying water from the base of the display to the upper portion of the display. At the upper portion the conduit empties into an outlet manifold 440 or other outlet formed to produce a gentle sheet of falling water that cascades down the front surface 450 of the wall. The receptacles 110 can be installed in the wall with spacers between the outer flange 130 so as to form an annular gap between the all and the underside 180 of the outer flange. This will allow water to flow around the receptacle body without coming into contact with the bottle. A light source 460 is provided at the back side of the wall to direct light into and partly through the transparent or semi-transparent receptacles. This creates a visually pleasing ring of light radiating around each bottle neck disposed in the receptacles. Each of the receptacles 110 is retained in its hole with the locking nut 120 shown in more detail in FIG. 1. A threaded ring nut 500 may be interposed between the locking nut or may be used instead of the locking nut as the means to secure the receptacle.

Figure 5:
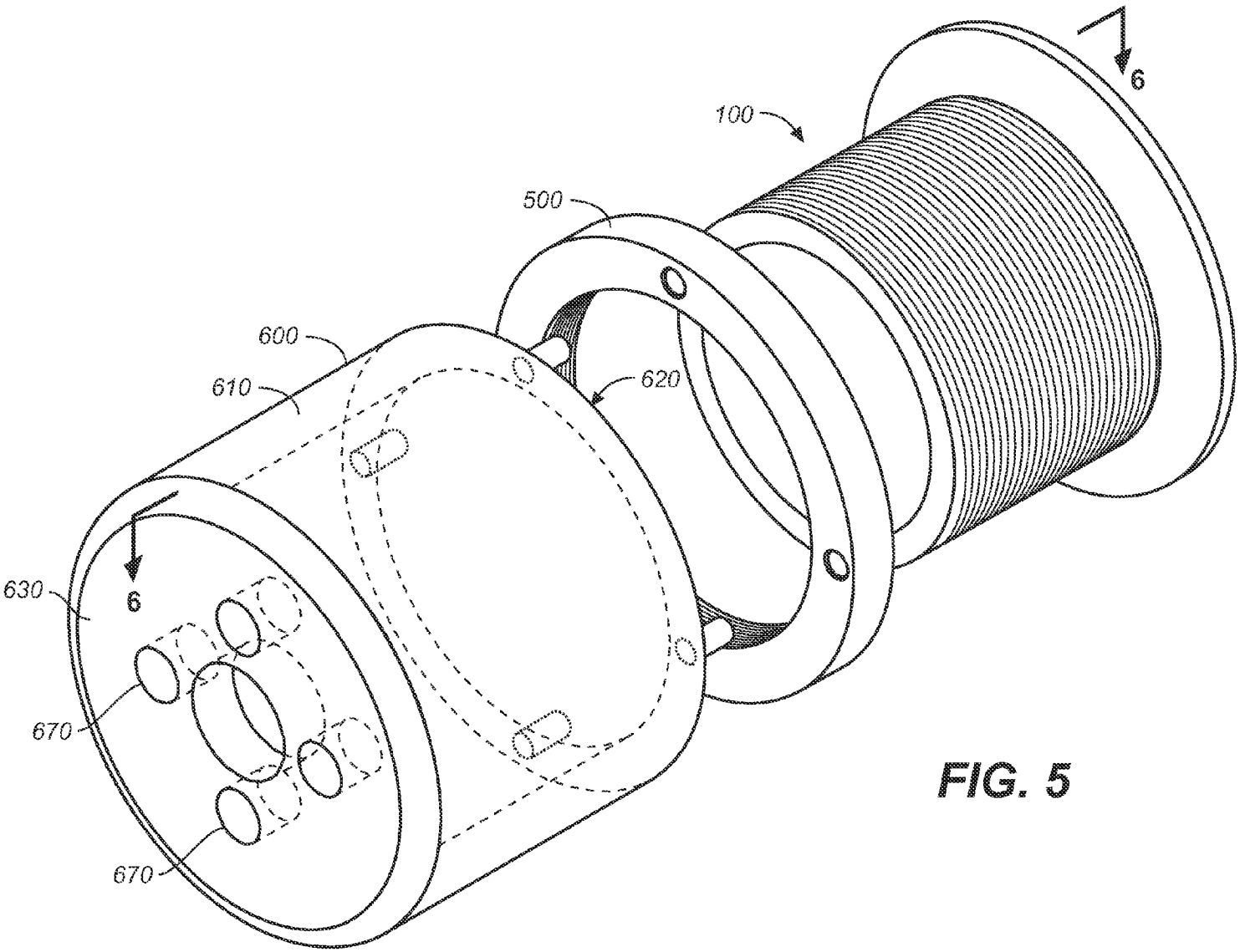
FIG. 5 is an upper exploded perspective view showing the elements for the assembly of the inventive cup, including the use of a ring nut and installation tool employed in the preferred embodiment of the present invention.
Figure 6:
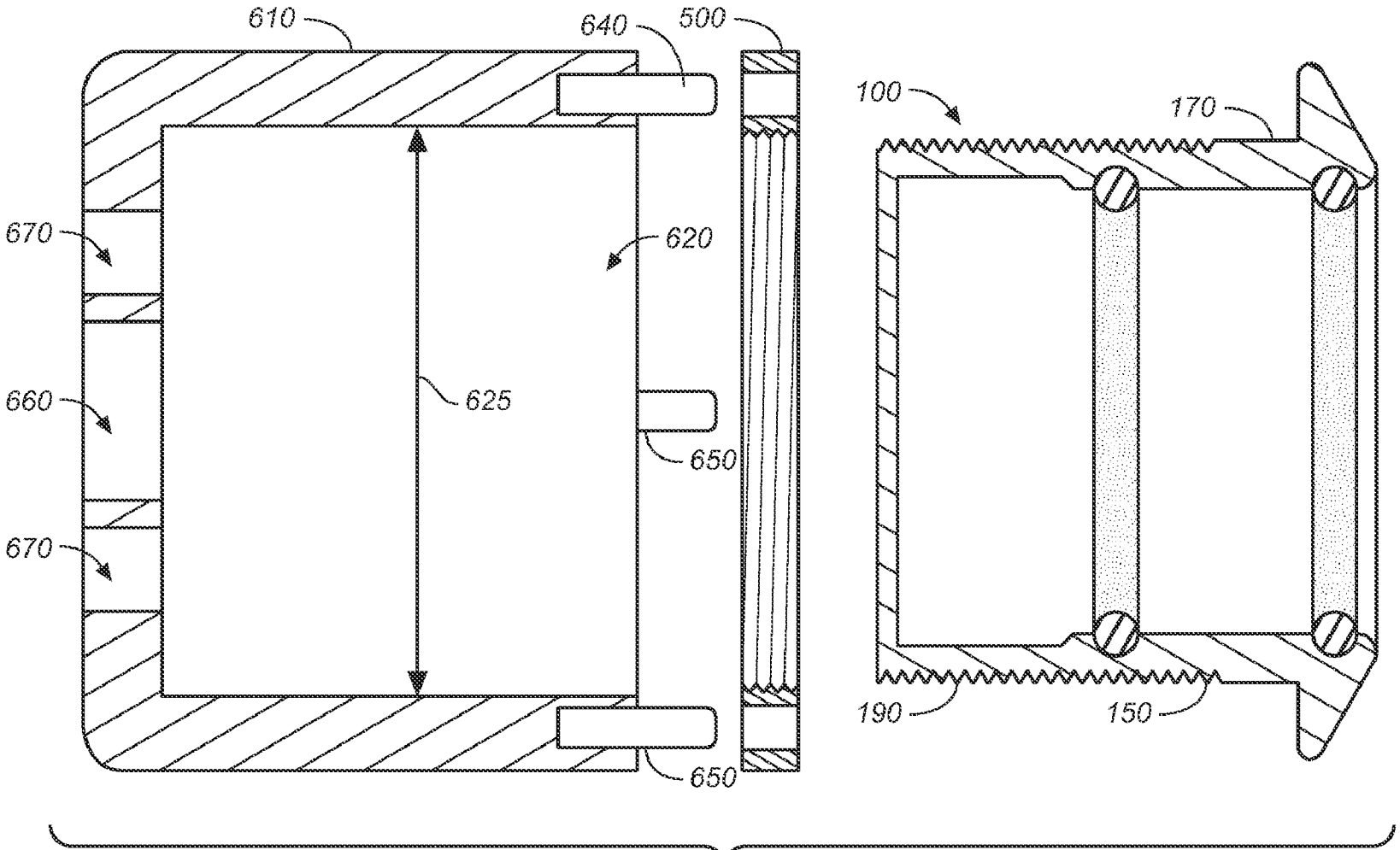
FIG. 6 is a cross-sectional side view in elevation of the elements shown in FIG. 5 taken along section line 6.

FIGS. 5-6 show the elements of the inventive assembly in more detail and generally indicate the method of assembling the bottle holding cup. These views also shows use of the ring nut 500 in more detail. The ring includes holes 510, preferably through holes, to accommodate pins on the cup installation tool 600 so as to facilitate rapid installation of the inventive bottle holder. The tool includes a cylindrical body 610 having an open first end 620 and a closed second end 630. The body includes a rim 640 at the open first end that includes pins 650 sized and spaced for insertion into the through holes 510 in the ring nut 500. The closed second end 630 includes a center hole 660 and a plurality of indexing holes 670 equidistantly spaced from the center hole so as to make the tool suitable for replacement of or placement on the drill arbor of a power drill, in much the same manner as a hole saw is installed and secured. The inner diameter 625 of the cylindrical body of the installation tool is slightly greater than the greatest outer diameter 142 of the cylindrical body 140 of the cup, such that when installing the inventive cup in a substrate with an exposed back side, the cylindrical body of the cup is inserted into the substrate hole, the ring nut 500 is placed onto the threaded exterior 150 of the cylindrical body and its threadable attachment is initiated with a few turns of the ring nut 500, the pins 650 on the tool are inserted into the holes 510 of the ring nut, and the power drill is employed to rapidly spin on and tighten the ring nut, potentially as far as the threads extend toward flange 130. The adjustable torque setting and clutch available on most contemporary cordless drills will allow users to control drive power and avoid over tightening the ring nut. If desired, a locking nut may be placed over the ring nut.

In another embodiment 700 (not shown, but described in detail herein), the decorative display made possible by the inventive bottle receptacle of the present invention, first and second spaced apart material panels 710, 720 are provided and are pivotally connected with one or more hinges 730 or are otherwise selectively coupled together in a spaced apart relationship. Accordingly, this embodiment comprises an identical wall to that shown in FIG. 4, but with the addition of a second wall pivotally connected to the first wall in a spaced apart relationship, with the space 740 defined between the panels. That space accommodates the inner portions 750 of the receptacle bodies as well as water conduits, if any, and one or more light sources 760, which may be one or more lights directed at the receptacles (as in FIG. 4) or LEDs 770 connected to a common power source (not shown) and affixed to the transparent or semi-transparent end caps 780 of the receptacles. As in the embodiment shown in FIG. 4, a water system can be incorporated into this embodiment, though the operative elements will be concealed between the space apart material panels.

From the foregoing, it will also be appreciated that the inventive assembly includes a novel method of installing a plurality of bottle holding receptacles in a wall or other structural substrate. The method includes the following method steps: (a) providing the above-described bottle holding cup (using the ring nut); (b) providing an installation tool that includes a cylindrical body having an open first end surrounded by a rim with a plurality of pins disposed on the rim and sized and spaced for insertion into the indexing through holes in said ring nut, and a closed second end having a center hole and indexing holes equidistantly spaced from the center hole so as to make the tool suitable for use with a drill, and having an open inner diameter slightly than the outer diameter of the cylindrical body of the bottle holding cup; (c) cutting a hole in a structural substrate; (d) inserting the cylindrical body of the bottle holding cup through the hole until the outer flange contacts the surface of the substrate; and (e) installing the ring nut onto the threaded exterior of the cylindrical body either manually or by using the installation tool in cooperation with a power drill.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A bottle holding cup for installation in a structural substrate, comprising:

a cylindrical receptacle portion having a cylindrical body with a threaded exterior side, an open mouth at an outer end, an outer flange surrounding said open outer end, a closed inner end, an interior side having a first annular channel disposed between said mouth and said closed inner end, a first annular resilient gasket disposed in said first annular channel, and a second annular channel spaced apart from said first annular channel and disposed between said first annular channel and said closed inner end and having a second annular resilient gasket disposed therein; and a threaded ring nut for installation on the threaded exterior side of said cylindrical receptacle portion;

wherein said receptacle portion includes a first cylindrical chamber proximate said mouth and having a first diameter, and a second cylindrical chamber extending from approximately said second annular gasket to said closed inner end and having a second diameter, said second diameter greater than said first diameter of said first cylindrical chamber, and wherein a ridge defines a transition from said first diameter to said second diameter, such that when said bottle holding cup is installed in a substrate in a generally horizontal orientation, and when a mouth and a portion of a neck of a corked wine bottle is inserted into said open mouth of said bottle holding cup the mouth of the bottle is generally brought into contact with said closed inner end, a bottle collar or a portion of the neck of the bottle proximate the collar is brought into engagement with said second annular resilient gasket in an upper portion of said cylindrical receptacle, a portion of the bottle neck more proximate the bottle shoulder than the bottle collar engages said first annular resilient gasket in an interior portion of the receptacle body, thereby retaining the bottle in the cylindrical receptacle and holding it at an angle in relation to a ground while keeping wine in the bottle in contact with the bottle cork, and wherein the bottle can be removed from the bottle holding cup simply by elevating the foot of the bottle so as to bring it out of engagement with said first and second annular resilient gaskets.

2. The bottle holding cup of claim 1, wherein the ridge is an outwardly angled ridge separating said first cylindrical chamber from said second cylindrical chamber.

3. The bottle holding cup of claim 1, further including a locking nut for threadable installation on said threaded exterior side of said cylindrical body and over said ring nut.

4. The bottle holding cup of claim 3, wherein said locking nut includes surface elements to facilitate gripping during installation and removal.

5. The bottle holding cup of claim 1, wherein said ring nut includes a plurality of indexing through holes.

* * * * *